United States Patent [19]

Nordeen

[11] 4,422,702

[45] Dec. 27, 1983

[54] VACUUM CLEANER ELECTRICAL CONNECTOR

[75] Inventor: Erwin E. Nordeen, St. Paul, Minn.

[73] Assignee: Whirlpool Corporation, Benton Harbor, Mich.

[21] Appl. No.: 306,283

[22] Filed: Sep. 28, 1981

[51] Int. Cl.[3] ..... H01R 4/64

[52] U.S. Cl. ..... 339/15

[58] Field of Search ..... 339/15, 16 R, 16 C, 339/28, 103 R, 103 C, 103 M, 107, 75 P; 15/339, 377; 174/47; 285/7

[56] References Cited

U.S. PATENT DOCUMENTS

| | | | |
|---|---|---|---|
| 3,127,227 | 3/1964 | Edwards | 339/15 |
| 3,553,629 | 1/1971 | Brown et al. | 339/15 |
| 3,659,248 | 4/1972 | Mann | 339/44 |
| 3,961,647 | 6/1976 | Doubleday | 138/103 |
| 3,965,526 | 6/1976 | Doubleday | 15/377 |
| 4,094,535 | 6/1978 | Minton | 285/7 |
| 4,127,316 | 11/1978 | McKee et al. | 339/103 |
| 4,165,140 | 8/1979 | Lyman et al. | 339/15 |
| 4,183,603 | 1/1980 | Donarummo | 339/75 P |
| 4,188,081 | 2/1980 | Holden et al. | 339/15 |
| 4,316,304 | 2/1982 | Parise et al. | 15/339 |

FOREIGN PATENT DOCUMENTS 54-160061 12/1979 Japan ..... 15/377

*Primary Examiner*—Joseph H. McGlynn
*Assistant Examiner*—David L. Pirlot
*Attorney, Agent, or Firm*—Wood, Dalton, Phillips, Mason & Rowe

[57] ABSTRACT

A vacuum cleaner electrical connector for use with a wand removably connected to a suction hose for providing electrical energy selectively to electrical apparatus associated with the wand. The electrical connector includes a plug housing carried on one end of the wand and a plug on one end of a power cord removably received in the plug housing. The plug housing defines a shoulder stop for preventing outward movement of the plug in the installed dispostion. The plug housing further includes cord-gripping structure which functions to retain the plug releasably in the installed disposition in alignment with the stop shoulder. The plug housing, in the illustrated embodiment, includes a base with the stop shoulder and cord retaining structure formed integrally therewith.

10 Claims, 5 Drawing Figures

FIG. 1
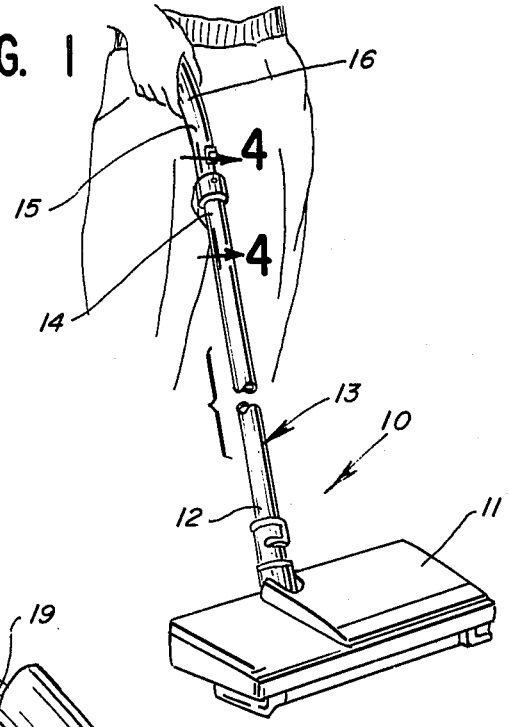
FIG. 3
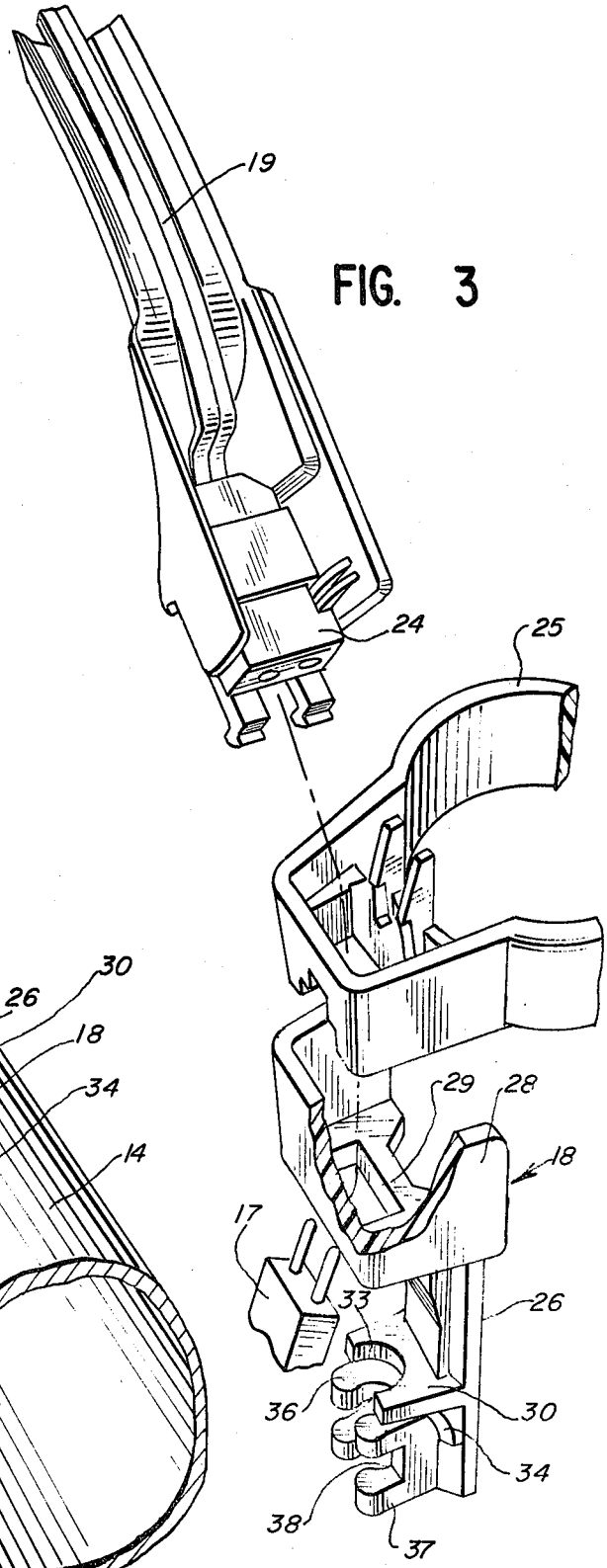
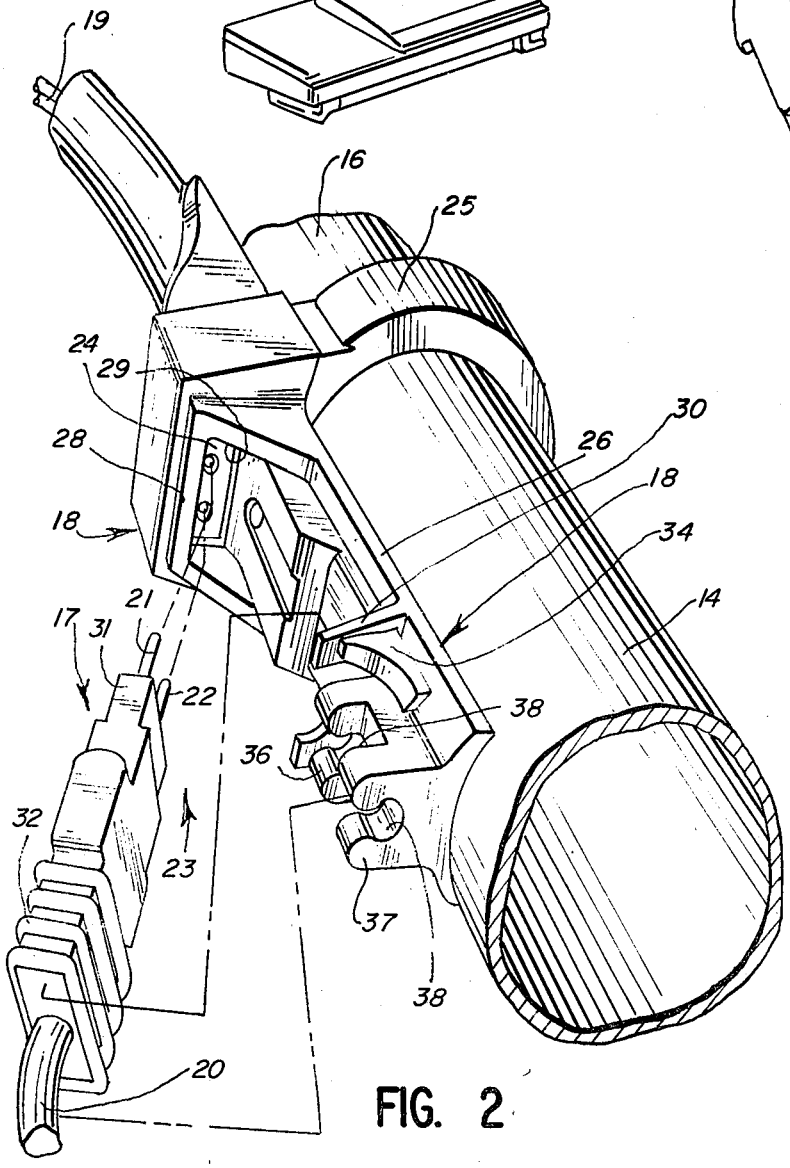
FIG. 2

VACUUM CLEANER ELECTRICAL CONNECTOR

BACKGROUND OF THE INVENTION

1. Field of the Invention

This invention relates to vacuum cleaner structures and in particular to means for providing separable electrical connection between a wand and suction hose portion of a vacuum cleaner structure.

2. Description of the Background Art

In U.S. Pat. No. 4,165,140 of John B. Lyman et al, which patent is owned by the assignee hereof, a vacuum cleaner attachment wand is illustrated having a demountable electrical connector. As disclosed therein, the connector is associated with a slide mounted on the wand. Electrical power is provided to a connector which is adapted to be mounted adjacent the slide. The slide is provided with an outwardly opening notch and stop. The plug of the electrical connector is slid along the slide for engagement therewith and a pivotable lock selectively retains the plug against the slide stop. While the Lyman et al electrical connector structure comprised an excellent electrical connector for use in such vacuum cleaner attachments, it was relatively expensive and the present invention is directed to the provision of an electrical connector for such use which is substantially less complex and costly.

Another form of vacuum cleaner connector is illustrated in U.S. Pat. No. 3,127,227 of Charles E. Edwards. As shown therein, the connector portion mounted to the hose end is locked in place on the hose end between inner and outer sleeves. The cooperating connector on the wand is simply plugged into the connector portion on the hose end.

Eric G. Doubleday illustrates, in U.S. Pat. No. 3,961,647, a vacuum cleaner connector plug provided at a freely extending distal end of the cord mounted to the wand. In the later patent of Eric G. Doubleday, U.S. Pat. No. 3,965,526, connectors are provided at the opposite ends of the cord carried by the suction hose assembly.

Another disclosure of a vacuum cleaner hose construction wherein the plug is mounted on the distal free end of the cord for selective engagement with the complementary connector element carried by the hose is disclosed in U.S. Pat. No. 4,094,535 of Keith G. Minton.

A clip for holding together an electric plug and socket on separate extension cords is disclosed in U.S. Pat. No. 4,183,603 of Robert Donarummo. The clip is generally U-shaped and has holes through the legs thereof for passing the cords permitting the interconnected plug and socket to be disposed between the legs in the connected arrangement.

Homer N. Holden et al, in U.S. Pat. No. 4,188,081, show a number of different adapters for use with the electrical connectors carried by the hose and wand elements of the vacuum cleaner.

In U.S. Pat. No. 4,211,457, Roger D. Meadows shows a connector on a vacuum hose having a pigtail-free shielded electrical connector assembly installed in self locked in position after assembly of the hose connector. The connector is adapted to be directly connected with a female electrical connector in a housing assembly of a canister-type vacuum cleaner.

SUMMARY OF THE INVENTION

The present invention comprehends an improved vacuum cleaner structure wherein a plug is removably mounted to the vacuum cleaner structure wand for selective engagement with a corresponding electrical connector portion carried by the hose.

The plug is provided at one end of the power cord connected to the electrical device provided at the opposite end of the wand.

The plug is removably received in a plug housing which is arranged to provide positive retention of the plug in accurate electrical connection with the complementary electrical connector of the hose while yet permitting ready disconnection of the plug when desired.

In the illustrated embodiment, the plug housing defines a base portion carried on the end of the wand, a guide portion having a through opening aligned with the electrical connection means on the hose end as an incident of the mechanical connection of one end of the wand to the suction hose end, and a rigid plug stop shoulder on the base portion spaced from the guide portion a preselected distance for effectively preventing movement of the plug outwardly from the guide portion through opening.

A retaining means may be provided on the base for releasably retaining the conducting means for movement away from the base, thereby defining means for effectively retaining the plug in the installed disposition inwardly of the top shoulder in the normal use of the apparatus.

In the illustrated embodiment, the plug stop shoulder and the retaining means are formed integrally with the base portion of the plug housing.

The retaining means, in the illustrated embodiment, comprises means for releasably gripping the cord adjacent the plug and, more specifically, is illustrated as including at least two pairs of cooperating gripping fingers for gripping the cord at spaced locations adjacent the plug.

The guide portion of the plug housing, in the illustrated embodiment, defines a guide surface outwardly of the through opening for slidably guiding the distal end of the plug into the opening with the other end of the plug extending angularly outwardly away from the base portion of the plug housing and permitting the other end of the plug to be subsequently moved inwardly toward the base portion to the installed disposition of the plug.

In the illustrated embodiment, web means are provided on the base of the plug housing outwardly of the stop shoulder means for rigidifying the stop shoulder means against outward deflection by the plug means. As shown, the web means may be formed integrally with the base portion and the plug stop shoulder portion of the plug housing.

More specifically, the invention comprehends an improved vacuum cleaner structure for use with a cleaning tool wand which may include a power driven brush. The vacuum cleaner structure includes an electrical insulator secured to the wand and having a receptacle to removably receive an electrical plug on the end of a power cord, a slot with cord grips to receive and grip the cord, and a stop to prevent movement of the plug longitudinally of the wand, and an insulated power cord having a plug to be removably received in the insulator receptacle, the plug having an extension of larger cross section than the insulation on the cord to cooperate with the insulator stop to provide a strain relief for the cord, whereby the wand may be used with a cleaning tool to transmit electrical power to the cleaning tool when it includes a power driven brush and the plug and cord may be readily removed from the wand when the wand is not being used with a power driven brush.

The vacuum cleaner structure of the present invention is extremely simple and economical of construction while yet providing a highly improved electrical connection means for use therein.

BRIEF DESCRIPTION OF THE DRAWING

Other features and advantages of the invention will be apparent from the following description taken in connection with the accompanying drawing wherein:

FIG. 1 is a fragmentary perspective view illustrating a vacuum cleaner construction having electrical connection means embodying the invention;

FIG. 2 is a fragmentary enlarged perspective view of the electrical connecting means of the present invention;

FIG. 3 is a fragmentary enlarged perspective view looking in a direction opposite to that of FIG. 2 and with parts broken away to facilitate illustration of the invention;

DESCRIPTION OF THE PREFERRED EMBODIMENT

Figure 4:
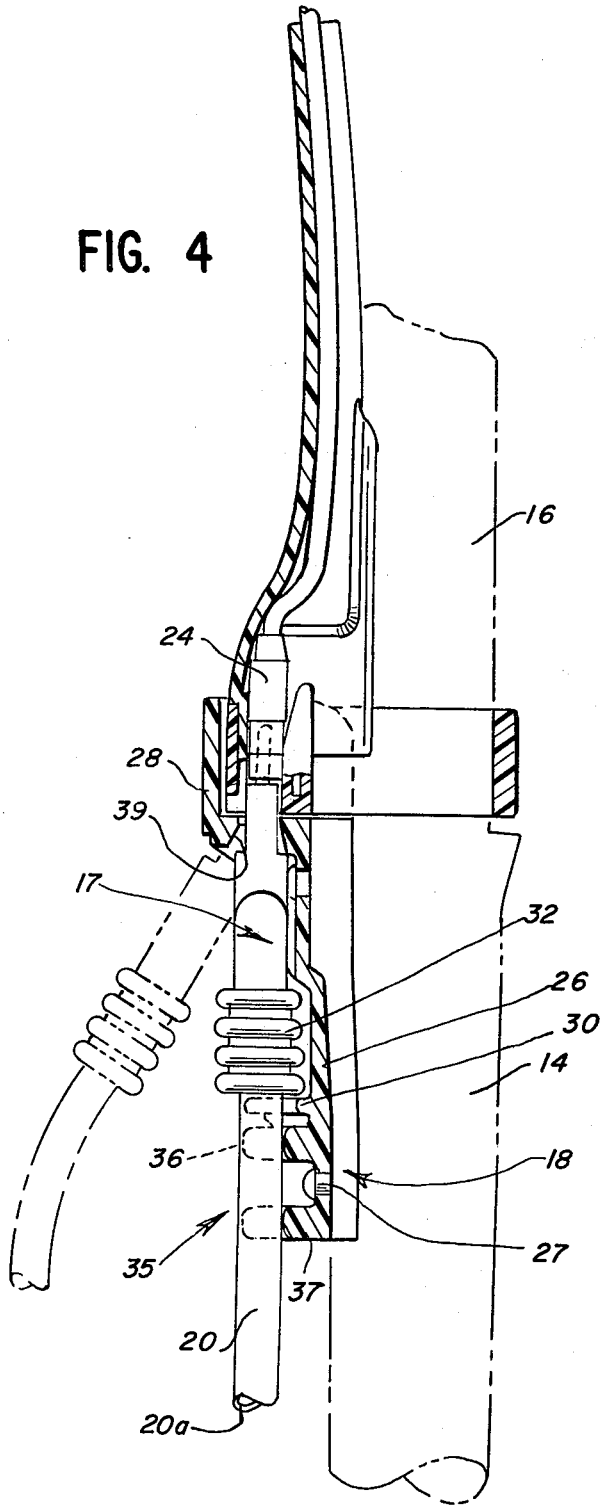
FIG. 4 is a fragmentary diametric section of the vacuum cleaner structure.

In the exemplary embodiment of the invention as disclosed in the drawing, a vacuum cleaner structure generally designated 10 is shown to include a suction nozzle 11 connected to one end 12 of a wand 13 having an upper end 14 removably mechanically connected to a handle end 15 of a suction hose 16 adapted to be gripped by the user of the vacuum cleaner structure in effecting a vacuum cleaning operation. The nozzle 11 may be provided with an electrically driven brush assembly (not shown) of conventional construction and the invention is concerned with the provision of an electrical connector plug generally designated 17 and associated plug housing 18 for providing electrical power to the nozzle electrical means from a power supply conductor 19 and through a power cord 20 connected to the plug 17. The power cord 20 is flexible and is provided with an outer wall **20*a*** of a suitable resilient electrical insulation material.

As shown in FIG. 2, plug 17 comprises a molded element illustratively carrying the male terminals 21 and 22 of the electrical connection means 23. An electrical connector receptacle 24 is mounted to the hose handle portion 16 within a housing 25.

Figure 5:
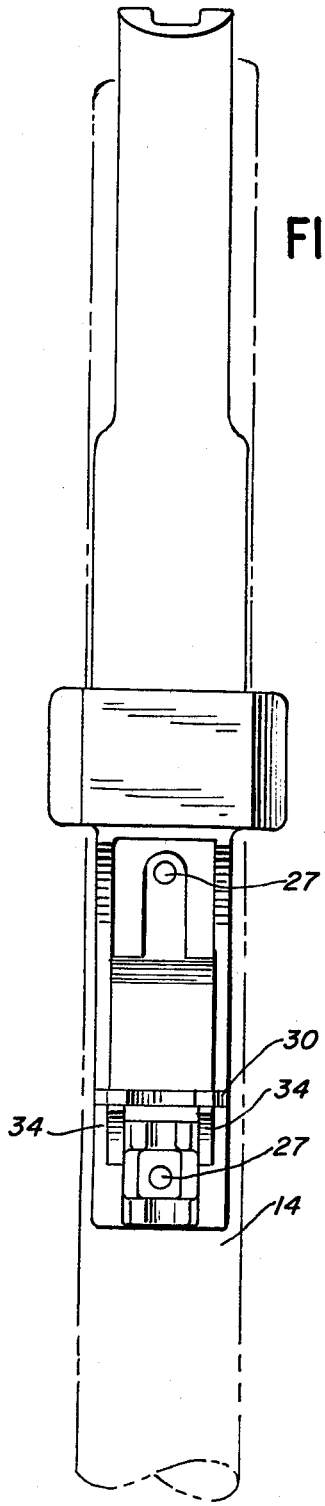
FIG. 5 is a fragmentary elevation of the hose and wand structure prior to the installation of the connector plug therein.

As best seen in FIG. 2, plug housing 18 includes a base portion 26 secured to wand end 14 by suitable means such as rivets 27 (FIG. 5).

The plug housing further defines a guide portion 28 provided with a through opening 29. Hose end 16 is removably received in wand end 14, and when so connected, the plug housing 29 is alligned with the receptacle 24 of the electrical connection means 23, as shown in FIG. 2.

As further shown in FIG. 2, a plug stop shoulder 30 is provided on the base portion 26 spaced outwardly from the guide portion 28 a preselected distance for effectively preventing movement of the plug 17 outwardly from the guide portion through opening when the plug is installed in a disposition with one end 31 of the plug received in the guide portion opening 29 and the opposite strain relief portion 32 of the plug juxtaposed inwardly of the stop shoulder 30.

As best seen in FIG. 3, the stop shoulder 30 comprises an upstanding transverse wall on the base portion 26 having a central semicylindrical recess 33 to accommodate cord 20 extending outwardly from the plug in the installed disposition. The stop shoulder 30 is rigidified by a pair of webs 34 formed integrally with the base portion 26 and extending outwardly from the stop shoulder to prevent deflection of the stop shoulder away from the plug guide portion 28 of the plug housing.

The plug housing is further provided with retaining means generally designated 35 for releasably retaining the resilient wall insulated conducting cord 20 from movement away from the base portion 26 of the plug housing, thereby effectively retaining the plug 17 releasably in the installed disposition between the plug housing portion 28 and the stop shoulder 30, as best seen in FIG. 4. In the illustrated embodiment, the cord retaining means 35 is defined by spaced pairs of gripping fingers 36 and 37, which are sufficiently resilient in a direction transverse to the longitudinal axis of insulated cord 20 to permit the resilient wall cord 20 to be releasably urged therebetween into an inner cord receiving recess 38 thereof.

In the illustrated embodiment, the various portions of the plug housing including the base portion 26, guide portion 28, stop shoulder 30, rigidifying webs 34, and cord retaining fingers 36 and 37 are formed integrally as a one-piece molded structure of suitable insulating material, such as synthetic resin. Thus, the plug housing may be manufactured at low cost.

Referring to FIG. 4, plug 17 is electrically connected to the receptacle 24 with the plug extending angularly toward the guide portion 28 with the strain relief portion 32 of the plug spaced away from the base portion 26 of the plug housing. To facilitate the electrical connection, the guide portion 28 is provided with a guide surface 39 which is angled outwardly away from the receptacle 24 for slidably directing the plug end 31 into the opening 29 so as to bring the terminals 21 and 22 of the plug accurately into electrical connected association with the receptacle 24. During the inward movement of the male terminals into the female receptacle, the plug may be swung inwardly toward the base portion 26 of the plug housing to dispose the strain relief portion 32 longitudinally inwardly of the stop shoulder 30 in the installed arrangement illustrated in FIG. 4. At the same time, the cord 20 may be pressed into the openings 38 between the cord retaining fingers 36 and 37 for releasably retaining the plug in the installed disposition of FIG. 4, thereby effectively precluding undesirable accidental disengagement of the plug from the receptacle 24 during use of the vacuum cleaner.

As indicated above, the stop shoulder 30 is rigidified against outward movement away from guide portion 28, thereby effectively maintaining the plug in the disposition shown in FIG. 4 until such time as the user swings the plug outwardly to the dotted line position of FIG. 4 in effecting disconnection of the plug from the receptacle 24 as when the vacuum cleaner is to be used without a power-requiring element, such as nozzle 11.

As will be obvious to those skilled in the art, the electrical connector 17, which has been characterized as a male connector plug, may comprise a female plug with the electrical connector 24 comprising a male element in the housing 25 within the scope of the invention.

The cooperating cord gripping fingers 36 and 37 effectively define a slot for receiving the power cord 20 outwardly of the strain relief portion 32 of the plug 17. The strain relief portion of the plug has a substantially greater extent than the cord and, thus, its engagement with the stop shoulder 30 effectively provides strain relief for the power cord connection to the plug.

Thus, the structure of the present invention provides an improved electrical connection means for use with the wand of a vacuum cleaner which may have selectively attached to one end thereof a device requiring electrical power or a device not requiring electrical power. The invention comprehends providing means for selectively retaining the electrical connection plug carried by the wand in positive electrically connected association with the electrical connection means carried by the hose handle end, while yet permitting facilitated disconnection thereof when desired. As indicated above, the structure is extremely simple and economical of construction while yet providing this improved, positive electrical connection means.

The foregoing disclosure of specific embodiments is illustrative of the broad inventive concepts comprehended by the invention.

The embodiments of the invention in which an exclusive property or privilege is claimed are defined as follows:

1. In a vacuum cleaner structure having a tubular air conducting wand provided at one end with connecting means for removable connection to a suction hose end having an electrical connection mounted thereto, the improvement comprising:.

a plug housing provided on said one end of the wand; and electrical conducting means including a plug and conductor cord means for providing an electrical supply extension from said hose electrical connection, said plug housing defining a base portion carried by said one end of the wand, a guide portion having a through opening aligned with said electrical connection on said hose end as an incident of mechanical connection of said one end of the wand to said suction hose end, a rigid plug stop shoulder on said hose spaced from said guide portion a preselected distance for effectively preventing movement of the plug outwardly from the guide portion through opening when the plug is in an installed disposition with one end of the plug received in said guide portion opening and the other end of the plug juxtaposed inwardly of said stop shoulder, and retaining means on said base outwardly of said stop shoulder for releasably retaining said conducting means from movement away from said base, said guide portion of the plug housing defining an inclined guide surface spaced from said base portion outwardly adjacent and extending toward said through opening and facing toward said plug stop shoulder and conducting means retaining means for slidably guiding said one end of the plug into said opening and said other end of the plug extending angularly outwardly away from the base adjacent said plug stop shoulder and conducting means retaining means, thereby permitting said other end of the plug to be moved inwardly toward the base to said installed disposition.

2. The vacuum cleaner structure of claim 1 wherein said plug stop shoulder is formed integrally with said base.

3. The vacuum cleaner structure of claim 1 wherein said retaining means is formed integrally with said base.

4. The vacuum cleaner structure of claim 1 wherein said retaining means comprises means for releasably gripping said cord adjacent said plug.

5. The vacuum cleaner structure of claim 1 wherein said retaining means comprises at least two pairs of cooperating gripping fingers for releasably gripping said cord adjacent said plug.

6. The vacuum cleaner structure of claim 1 wherein web means are provided on the base outwardly of the plug stop shoulder for rigidifying the stop shoulders against outward deflection by said plug.

7. The vacuum cleaner structure of claim 1 wherein web means are formed integrally with said base and plug stop shoulder extending outwardly from the stop shoulder for rigidifying the stop shoulders against outward deflection by said plug.

8. The vacuum cleaner structure of claim 1 wherein said retaining means comprises a pair of opposed cord gripping fingers.

9. The vacuum cleaner structure of claim 1 wherein means are provided for causing the plug stop shoulders to be rigid in a direction away from the insulator receptacle.

10. The vacuum cleaner structure of claim 1 wherein said retaining means is defined by a plurality of pairs of opposed cord gripping fingers, said pairs being spaced apart in a direction away from said guide portion.

* * * * *